US005988413A

United States Patent [19]

Nagel

[11] Patent Number: 5,988,413

[45] Date of Patent: Nov. 23, 1999

[54] CHILD RESISTANT CONTAINER AND CLOSURE

[75] Inventor: Robert C. Nagel, Venice, Calif.

[73] Assignee: JSN Product Concepts, Inc., Irvine, Calif.

[21] Appl. No.: 09/099,069

[22] Filed: Jun. 17, 1998

Related U.S. Application Data

[60] Provisional application No. 60/049,932, Jun. 18, 1997.

[51] Int. Cl.[6] ..... B65D 55/02

[52] U.S. Cl. ..... 215/216; 215/221; 215/228; 215/313; 215/334

[58] Field of Search ..... 215/216, 217, 215/218, 219, 220, 221, 228, 313, 314, 334

[56] References Cited

U.S. PATENT DOCUMENTS

| | | | |
|---|---|---|---|
| 3,669,294 | 6/1972 | Petronelli . | |
| 3,944,101 | 3/1976 | Landen et al. | 215/216 |
| 3,977,554 | 8/1976 | Costa . | |
| 4,116,351 | 9/1978 | Uhlig | 215/216 |
| 4,138,028 | 2/1979 | Price et al. . | |
| 4,223,793 | 9/1980 | Patton . | |
| 4,331,247 | 5/1982 | Mumford . | |
| 4,413,742 | 11/1983 | Sandhaus | 215/216 |
| 4,752,013 | 6/1988 | Miller et al. | 215/216 |
| 5,186,369 | 2/1993 | Aguirrezabal . | |
| 5,505,346 | 4/1996 | Smith . | |
| 5,603,421 | 2/1997 | Opresco | 215/217 |
| 5,836,467 | 11/1998 | Montgomery | 215/216 |

*Primary Examiner*—Stephen K. Cronin
*Attorney, Agent, or Firm*—King and Schickli

[57] ABSTRACT

An improved child resistant container and closure assembly allows for ease of use by an adult, while at the same time provides the desired increased child resistance. One or more locking elements mating with recesses formed in the container serve to secure the closure assembly to the container. The closure assembly is also provided with a cup portion that is adapted for comfortably receiving an adult hand. Differential manual pressure applied to the closure assembly flexes an internal annular web, which removes the locking elements from their respective recesses. This allows an adult to easily open the container, whereas a child cannot do so. In an alternate embodiment, the closure assembly is non-removable, and is adapted to permit flow-through of the material held within the container.

13 Claims, 5 Drawing Sheets

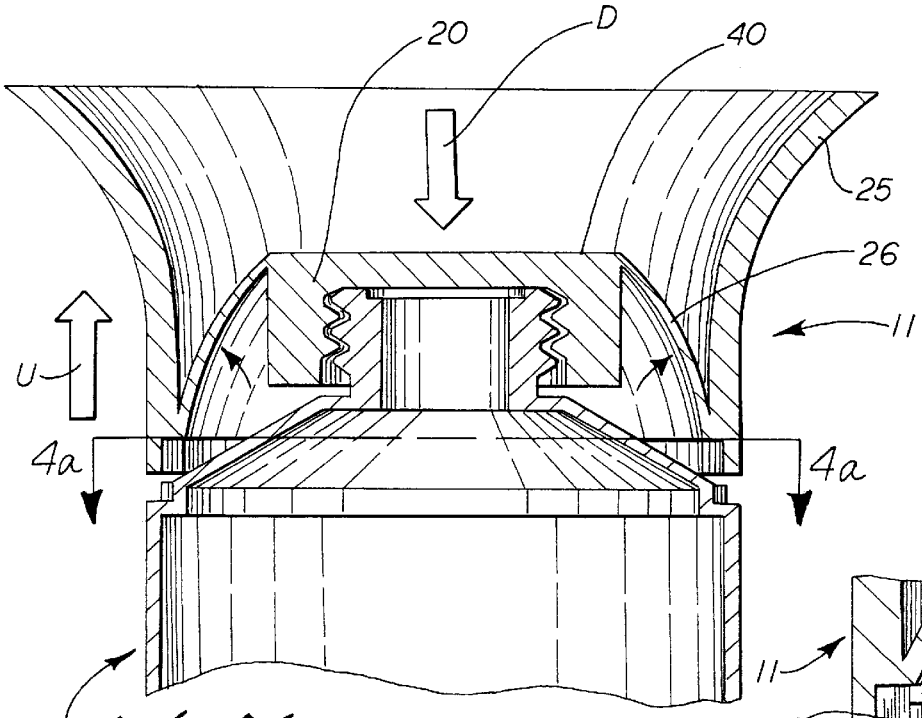
Fig. 3
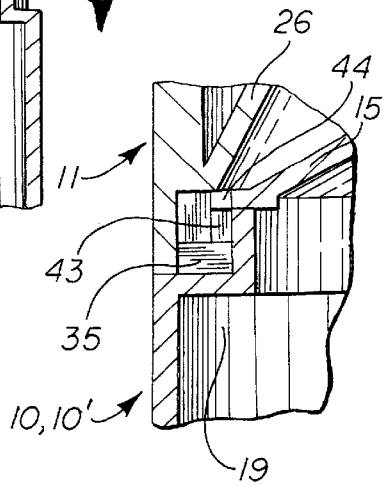
Fig. 7a
Fig. 6
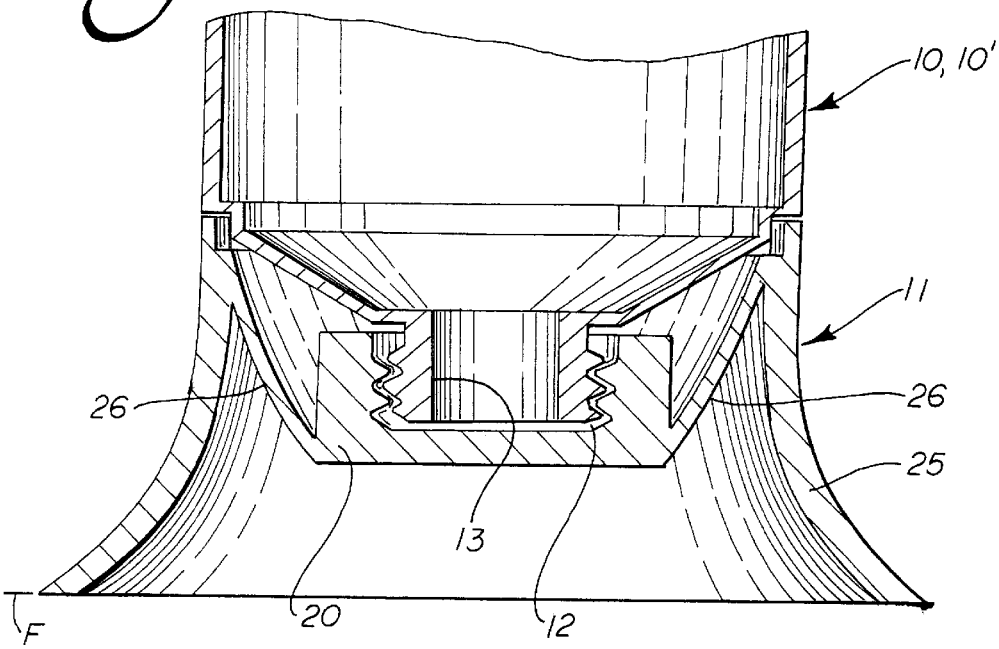

CHILD RESISTANT CONTAINER AND CLOSURE

Portions of this application claim the benefit of U.S. Provisional Application Serial No. 60/049,932, filed Jun. 18, 1997, entitled "Child Resistant Container and Closure."

TECHNICAL FIELD

The present invention relates to child resistant closures and, more particularly, to the combination of a container, such as a tube or bottle, and a closure locked on the container body to prevent access by children yet relatively easy removal by an adult.

BACKGROUND OF THE INVENTION

In the past, numerous attempts have been made to make a successful child resistant closure that is fully reliable, and at the same time is easy for adults to manipulate for both opening and closing a container. Most prior attempts include a two part construction having an inner cap and a separate outer cup-like drive member, such as shown in U.S. Pat. No. 3,977,554 to Costa. In the '554 patent, the drive member is loosely positioned about the inner cap and gravity is relied upon to make certain that the two parts are disengaged when the cap is closed. To open the container, the adult grasps the outer drive member to lift it such that opposing tabs are in engagement allowing the cap and drive member to rotate together during turning. In view of the fact that gravity alone is relied upon to separate the two operational parts, such a cap is not fully reliable. Also, since the closure must be manufactured in two parts, the production cost is significantly increased.

Several attempts have been made to devise a locking cap that is formed of a single piece construction, such as that shown in U.S. Pat. No. 4,138,028 to Price et al. However, in the instances that I am aware, these closures require significant side squeezing and excessive flexing movement of the locking elements, both during removal and replacement of the cap to the container. For example, in the '028 patent, the cap must be squeezed at both sides while being turned, the only significant difference being that the closing action is made easier due to the use of cam surfaces. These caps are not as reliable to resist opening since there is no required up or down movement of an outer drive member with respect to the cap.

Therefore, a need is identified for improving the known child resistant closures so as to overcome the shortcomings of the prior art. Specifically, the closure should resist opening by children, but be manipulatable by an adult hand such that it is easy to remove. The closure would have a user-friendly shape, thus enhancing the ease of use. Furthermore, both the container and closure would be of simple and inexpensive construction, and would be easy to produce using methods well-known in the container forming art.

SUMMARY OF THE INVENTION

Keeping the above needs in mind, it is a primary object of the present invention to provide an improved container and closure combination that is resistant to opening by children, yet is easily opened by adults.

Another object of the present invention is to provide a closure that includes a driven lock mechanism that provides a secure, but releasable connection with the container.

Still another object is to provide a container with a closure assembly having an improved user-friendly design that is easily and comfortably grasped by the adult hand to permit removal or replacement.

A further object of the invention is to provide a child resistant container having a non-removable closure assembly that permits flow-through of materials, such as viscous liquids, held within the container.

Yet another object is to provide an improved child resistant container and closure that is relatively simple in design and inexpensive to produce.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved child resistant container and closure assembly is disclosed. The upper body of the container includes a cylindrical threaded neck and a shoulder portion extending from the neck. A first lock element, such as an inwardly projecting recess, is formed in the container adjacent to the shoulder portion. The closure assembly includes a mating cap portion with a threaded opening for receiving the threaded neck of the container.

In accordance with an important aspect of the present invention, the closure assembly is provided with a cup extending around the cap portion. As described further below, the cup is preferably adapted to be easily grasped by an adult hand. A second lock element for mating with the recesses formed in the container is also formed in the closure assembly. Preferably, the second lock element takes the form of an inwardly projecting tab.

To permit the improved ease of removal that is characteristic of the present invention, a resilient member is attached to the cap portion of the closure assembly. In the preferred embodiment, this resilient member takes the form of an annular web. In addition to supporting the cup, the web also permits upward flexing movement of the tab to disengage it from the recess. Thus, when an adult hand grasps the closure assembly in the preferred manner, as described below, differential pressure is exerted between the cap portion and the cup. This serves to lift the cup sufficiently to disengage the lock element from the recess formed in the container body. The closure assembly is simply rotated by simultaneously manually turning the cup to effect removal from the container body and permit access to the material held therein.

Further explaining the differential pressure, the cap portion preferably includes a top surface opposite the threaded opening to receive the thumb of the user. The cup is ideally flared upwardly and outwardly from the bottom edge to form a curved frusto-conical outer surface. This flared surface advantageously allows the forefinger/middle finger of the adult user to engaging opposite sides of said outer surface of the cup. To open the container, downward pressure is simply applied by the thumb of the user to the top portion of the closure assembly, while the forefinger/middle finger serve to produce upward pressure on the flared outer edge of the cup. This is the differential manual pressure that causes the lock element to disengage from the recess in the container, thereby permitting rotation and removal of the closure assembly to access the material held therein. As should now be appreciated, this provides a container and closure assembly that is easily manipulated by adults, but is resistant to being opened by children.

In accordance with another aspect of the present invention, the closure assembly forms a base for the container when it is inverted. More specifically, the cup is flared such that it extends outwardly from the radial extent of the container. This increases its adaptability to serve as a base to hold the inverted container upright on any flat surface with enhanced stability. This is not only particularly desirable for standing the tube vertically, but also advantageously allows material inside the container, such as viscous liquid, to remain adjacent the dispensing orifice for more convenient, immediate use.

In the preferred embodiment, the tab which provides the locking arrangement to the closure assembly has a chamfered leading edge forming a cam. The inside tip of the tab engages the recess and the chamfered edge forming the cam mates with a corresponding angled surface formed in the recess. Once the tab is brought into engagement with the shoulder, the closure assembly can be brought into full seated relationship on the container by exerting minimum or no differential pressure. Thus, the container is sealed in its original locked position. Moreover, this locking feature also assures the adult user that the container is closed in a locked relationship.

In an alternate embodiment, the closure assembly is non-removable and is adapted to permit material held within the container to flow-through the cap portion. Specifically, the top surface of the cap portion is provided with an aperture and the threaded opening of the container has a plug formed therein for mating with the aperture. A skirt formed in the closure assembly concentric with the aperture assists in sealingly engaging the plug in the closed position.

The shoulder of the container is provided with an annular guide track formed adjacent to the recess and extending partially along the circumference. This guide track serves to receive and trap the tab once it is unseated from the recess by the application of differential manual pressure to the closure assembly, as described above. Once unseated, the closure assembly can be rotated by manually turning the cup such that material in said container can flow past the plug and through the aperture. However, the guide track is finite and, therefore, forms a stop which prevents the closure assembly from being fully rotated and removed. Advantageously, this partial rotation allows the material to be accessed without necessitating full removal of the closure assembly from the container.

Still other objects of the present invention will become apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description that follows serve to explain the principles of the invention in both of its embodiments. In the drawings:

FIG. 3 is a cross sectional view illustrating the manner in which the closure assembly is lifted ready for turning in response to differential manual pressure;

FIG. 6 is a cross sectional view illustrating the tube/bottle of FIGS. 1 and 5 inverted and supported with enhanced stability by the closure assembly of the present invention.

FIG. 7*a* is a enlarged cross-sectional view illustrating the tab positioned along the guide track formed in the shoulder of the container that prevents the closure assembly from being fully removed;

Reference will now be made in detail to the present preferred embodiment of the invention, as illustrated in the accompanying drawings.

DETAILED DESCRIPTION OF THE INVENTION

Figure 1:
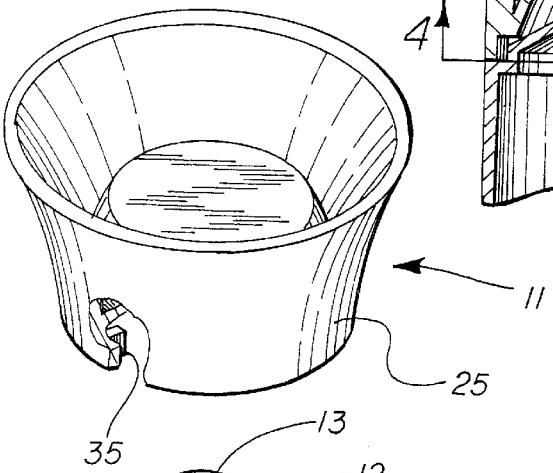
FIG. 1 is a perspective view of a container, such as a tube or bottle, having a threaded dispensing opening and a closure assembly illustrated in a position above the container ready for placement in locking position.
Figure 1:
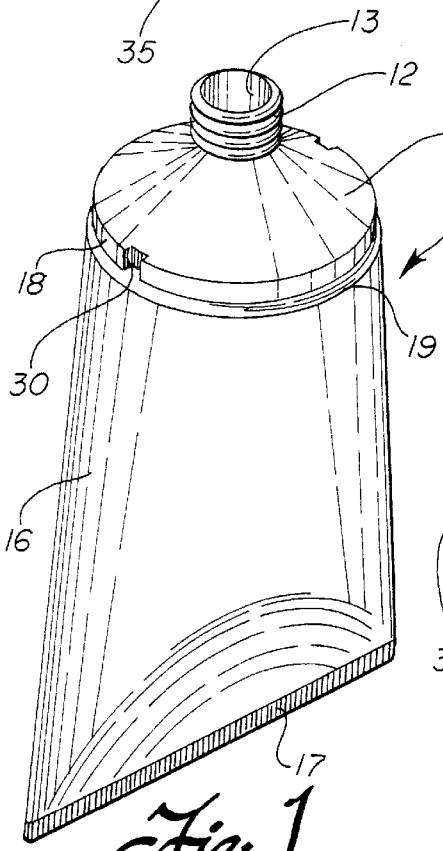
Figure 5:
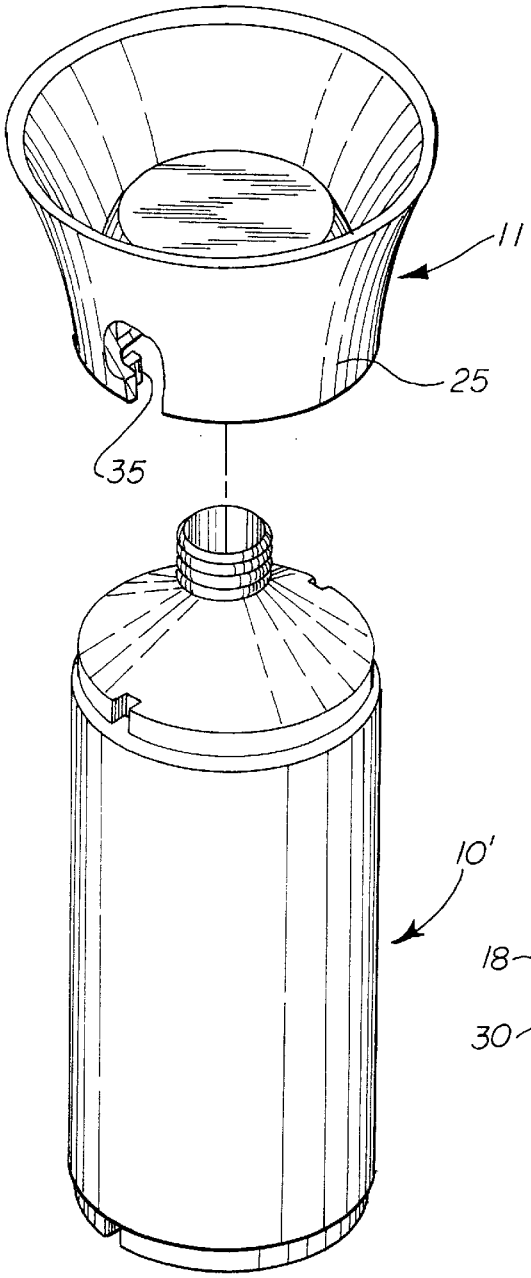
FIG. 5 is a perspective view of an alternative container, such as a bottle, that is also suited for use with the closure assembly in a manner similar to the container embodiment of FIG. 1.

Reference is now made to FIG. 1 illustrating a preferred embodiment of an improved child resistant tube 10 and matching closure assembly 11, constructed in accordance with the principles of the present invention. Tube 10 is an example of the type of container that can be considered as a part of the present inventive concept. However, other equivalent containers, such as the bottle 10' of FIG. 5, is to be considered with respect to all aspects of the present invention. As illustrated, both the tube 10/bottle 10' include a threaded neck 12 that forms the typical dispensing orifice 13 when the container is inverted. As will be apparent, the tube 10/bottle 10', as well as the closure assembly 11, is typically formed of injection molded plastic.

With reference now back to FIG. 1 exclusively, the tube 10 further includes a shoulder portion 15 sloping downwardly (when the tube 10 is in the upright position) to a body 16 that is closed at the bottom by a heat and compression formed fin seal 17. The shoulder 15 is connected to the body 16 by an undercut 18 in the form of a circular vertical wall and a horizontal rim 19.

Figure 2:
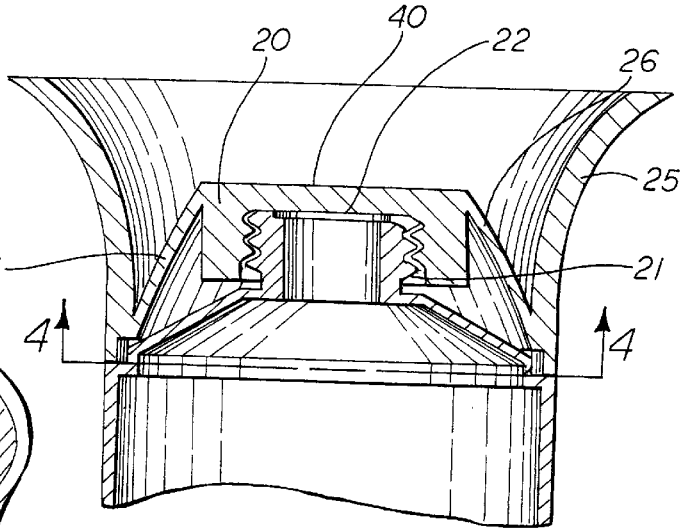
FIG. 2 is a cross sectional view taken through the top of the container and through the closure assembly of the present invention, the closure assembly being secured in the locked mode.

As best shown by reference now to FIG. 2, the closure assembly 11 includes a cap portion 20 defining a threaded opening 21 for receiving the threaded neck 12 and sealing the dispensing orifice 13. A deformable ring seal 22 is provided on the inside face of the opening 21 and engages the upper rim surface of the neck 12, as shown in FIG. 2. The cooperating threads of the neck 12/opening 21 are molded so that when the closure assembly 11 is in the final sealed position compressing the deformable seal 22, the lock elements establishing the locking relationship are firmly engaging each other, as will be described in detail below.

In accordance with an important aspect of the present invention, the closure assembly 11 includes a cup 25 that extends around the cap portion 20 in the manner clearly shown in FIGS. 2 and 3. Interconnecting the cap portion 20 and the cup 25 is a resilient member, which in the preferred embodiment takes the form of an annular web 26. As illustrated, the resilient annular web 26 extends substantially around the full inside periphery of the cup 25 and around the outside of the cap portion 20, thereby establishing a full peripheral connection. Since the web 26 is resilient, it can be flexed upwardly, in the manner shown in FIG. 3. When released, the resilient memory faithfully returns the web 26 to the original position, shown in FIG. 2. This upward flexing movement is important in releasing the locking relationship between the tube 10 and closure assembly 11, and then automatically reestablishing the locking relationship after the upward manual pressure and flexing is released.

Figure 4:
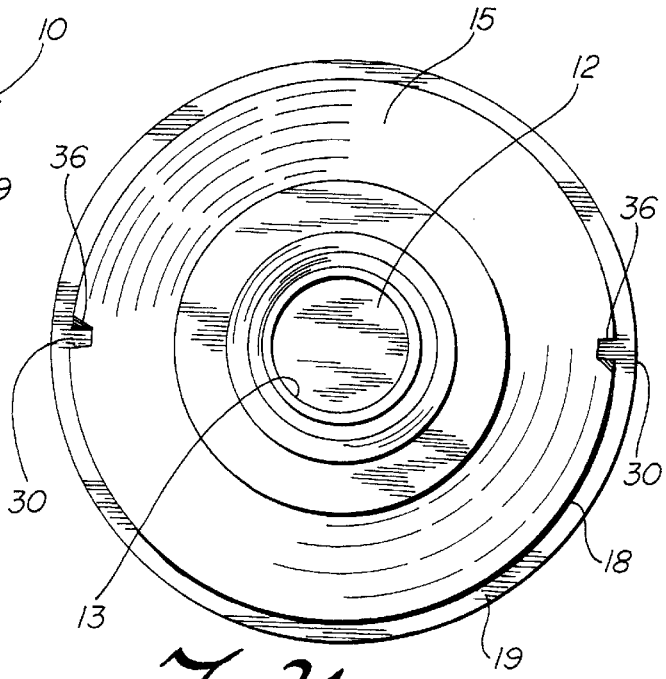
FIG. 4 is a top plan view of the container illustrated in FIG. 1 showing the threaded dispensing opening, the shoulder and rim of the top of the container and the opposed locking recesses formed in the shoulder.

As best illustrated in FIGS. 1 and 4, a first lock element is formed in the tube 10 adjacent the shoulder portion 15. In the preferred embodiment, the first lock element takes the form of a recess 30 indented within the undercut 18 and extending inwardly from the rim 19. If desired, more than one lock element may be employed. For example, two oppositely positioned locking recesses 30 are shown in FIGS. 1 and 4.

Figure 4A:
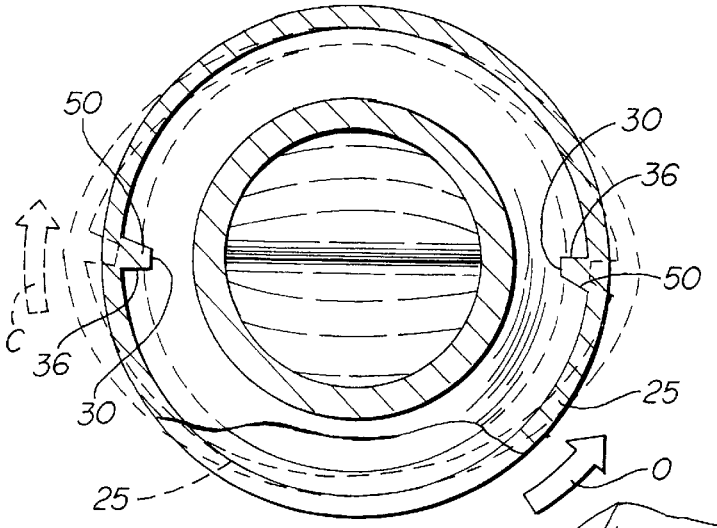
FIG. 4*a* is a cross sectional view taken along lines 4*a*—4*a* of FIG. 3 illustrating the manner in which the locking tab partially engages the mating recess to lock the closure assembly on the container, and with a broken away and dotted line illustration of the closure assembly allowing flexing during rotation in the closing direction.

To complete the locking relationship between the tube 10 and the closure assembly 11, a second disengageable lock element is provided adjacent the bottom edge of the cup 25 in order to mate with the recess 30. The preferred embodiment of the second lock element takes the form of a tab 35 (see, in particular, FIG. 1 and FIG. 4*a*). As will be evident, at least the tip of the tab 35 fits into the recess 30 resulting in a locking relationship to prevent the closure assembly 11 from being rotated in the opening direction, as illustrated by the action arrow O in FIG. 4*a*. The locking relationship is established by mating engagement of the substantially radially extending locking edge 36 (see FIG. 4*a*) with the corresponding radial edge of the recess 30.

As best illustrated in FIGS. 2 and 3 of the drawings, the cap portion 20 includes a top surface 40 opposite the threaded opening 22. This top surface 40 is adapted to receive downward manual pressure, as illustrated by the action arrow D of FIG. 3. Also, as illustrated, the resilient web 26 extends from adjacent the top surface 40 downwardly to adjacent the bottom edge of the cup 25. In addition to downward manual pressure D that is provided in the unique manner of the present invention, upward manual pressure, represented by the action arrow U, is also provided simultaneously. Taken added together, the downward manual pressure D and the upward manual pressure U, provide a differential pressure that permits release of the locking relationship between the tab 35 and the locking recess 30. In other words, upon applying differential manual pressure between the cap portion 20 and the cup 25, the annular web 26 is resiliently expanded sufficiently to disengage the tab 35 (second lock element) from the recess 30 (first lock element) in a unique manner, as shown in FIG. 3. In the preferred embodiment, after the recess 30/tab 35 (locking elements) are disengaged, the cap portion 20 is rotated to remove the closure assembly 11 by manually turning the cup 25.

It should be appreciated that the application of differential manual pressure and simultaneous turning of the closure assembly 11 relative to the container 10 is provided in a very unique manner. This is particularly advantageous in that it is easy for adults to perform, but difficult for children, thereby providing the container and closure assembly with the desirable child resistant features.

Figure 3A:
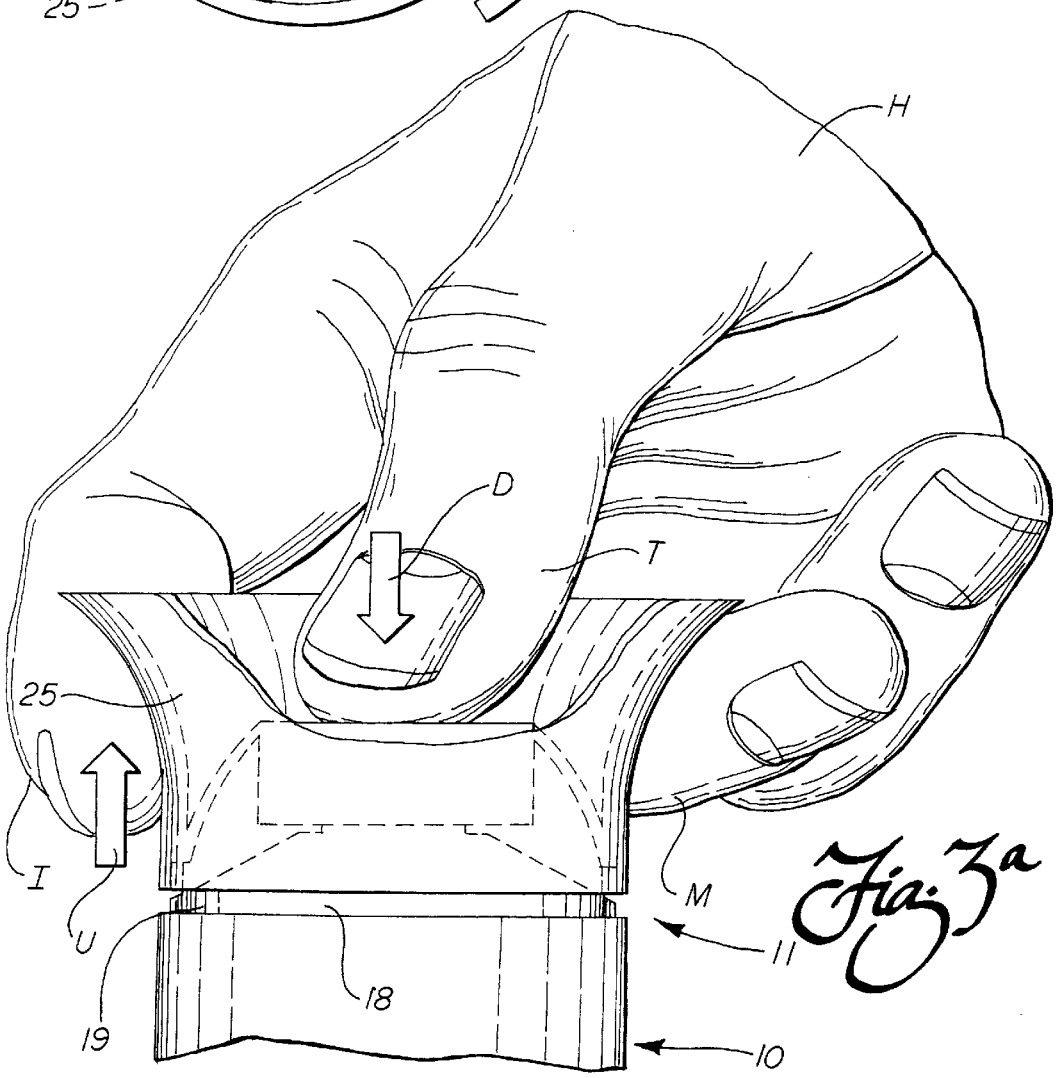
FIG. 3*a* is a side view of the container and the closure assembly illustrating the preferred manner in which the differential manual pressure can be provided in order to easily release the lock elements ready for manual turning for opening the container for dispensing.

To explain further, the container and closures is designed for use by an adult hand H with a thumb T positioned to perform the downward manual pressure D (see action arrow in FIG. 3*a*). The index finger I and the middle finger M are comfortably positioned on opposite sides of the cap 25 so as to simultaneously provide for the upper manual pressure U. As a part of the inventive concept, we have discovered that this adult manipulation uses the thumb T in combination with the spread-apart index finger I and the middle finger M to thereby simulate the basic pick-up motion frequently employed by a person each day. It is contemplated that this is one aspect that lends itself to the enhanced ease of manipulation for release of the locking engagement between the tab 35 and the locking recess 30. In short, this locking arrangement of the present invention is very easy for adult use, while at the same time highly child resistant.

In accordance with another aspect of the present invention, the annular web 26 extends substantially around the full periphery of the inside of the cup 25 and around substantially the full outside of the cap portion 20. This provides for a highly secure closure assembly 11. Not only is the resilient flexing for release of the locking relationship reliable, but at the same time, the interconnection through the web 26 permits full force turning action for disengagement of the threaded coupling between the neck 12 and the opening 22.

Additionally, to assure that the annular web 26 provides reliable upward flexing upon application of the differential manual pressure D, U for removal of the closure assembly 11, said web 26 has a slight upward bow permanently formed in the molded plastic (see FIGS. 2 and 6). This allows fully reliable upward and outward bowing action, as shown by the curved action arrows in FIG. 3.

In accordance with another feature of the present invention, the sidewalls of the cup 25 are flared upwardly and outwardly from the bottom edge to form a curved frusto-conical outer surface (see FIGS. 3, 3*a*). This particular shape provides a particularly efficient surface for engagement by the fingers I, M since the curved surface prevents the fingers from slipping over the top of the closure assembly 11. Thus, the differential manual pressure D, U, comprising the span between downward and upward pressures, is easily applied. The thumb T engages the top surface 40 and the forefinger I/middle finger M engage the opposite sides of the outer frusto-conical surface of the cup 25, in an inherently natural grasping manipulation.

As best illustrated in FIG. 6, the frusto-conical shape of the cup 25 increases its adaptability to serve as a base to hold the inverted tube 10/bottle 10' upright on any flat surface F. The cup extends sufficiently outwardly beyond the radial extent of the tube 10, or the bottle 10', to provide enhanced stability as the base. This is not only particularly desirable for standing the tube 10/bottle 10' vertically, but also at the same time allows material inside the container, such as viscous liquid, to remain adjacent the dispensing orifice 13 for more convenient, immediate use.

With reference back specifically to FIG. 4*a*, the manner in which at least the tip of the tab 35 (second lock element) is designed to substantially fit the locking recess 30 (first lock element) is shown in full line outline. The tab 35 has a chamfered leading edge forming a cam 50 in the closing direction C of rotation (see dotted line action arrow). The tab 35 is actually formed by the undercut of the bottom edge of the cup 25.

The inside tip of the tab 35 engages the recess 30 and the chamfered edge forming the cam 50 mates with the corresponding angled surface in the recess 30. Upon hand rotation in the closing direction C, once the tab 35 is brought into engagement with the shoulder 15 by the threaded relationship of the neck 12/cap portion 20, then by exerting minimum or no differential pressure U, D, the closure assembly 11 can be brought into full seated relationship on the container 10.

To accommodate this action, with respect to the rim 19 the bottom edge of the cup 25 is made approximately one half as thick. The sides of the bottom edge of the cup 25, in a position spaced at 90° from the one or more tabs 35, are then able to flex inwardly along the undercut 18 (only one side shown as flexing in FIG. 4*a*). This allows outward flexing of the bottom edge of the cup 25 adjacent the tab 35 (see partial dotted line outline in FIG. 4*a*). The cam edge 50 cooperates with the corresponding angled edge of the recess 30. Upon turning of the closure assembly 11, the tab 35 snaps past the recess 30 during rotation in the closing direction C.

When the closure assembly 11 is fully seated, the neck 12 is fully sealed and retained in the locking relationship within the cap 20. By allowing the tab or tabs 35 to snap past the corresponding recess 30 during rotation in the closing direction C, the combination of the container 10, 10' and the closure assembly 11, is made even easier to use. This adds another dimension to the child resistant feature of the present invention, since the adult using the container is assured of fully closing and engaging the locking relationship. As an indicator of the fully closed relationship, the bottom edge of the cup 25 engages the rim 19 and the outer peripheries of the tube 10/bottle 10' and the cup 25 match so as to form a smooth transition.

Figure 7:
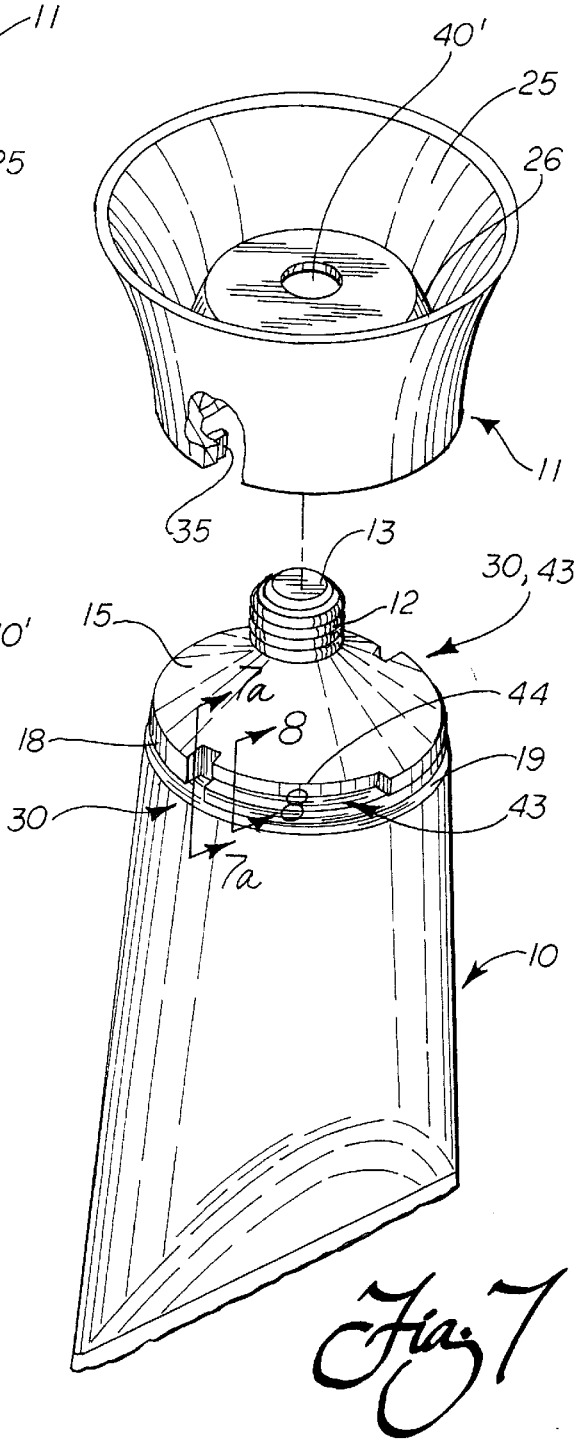
FIG. 7 is a perspective view of an alternate embodiment having a non-removable closure assembly that permits flow-through of the material held within the container.
Figure 8:
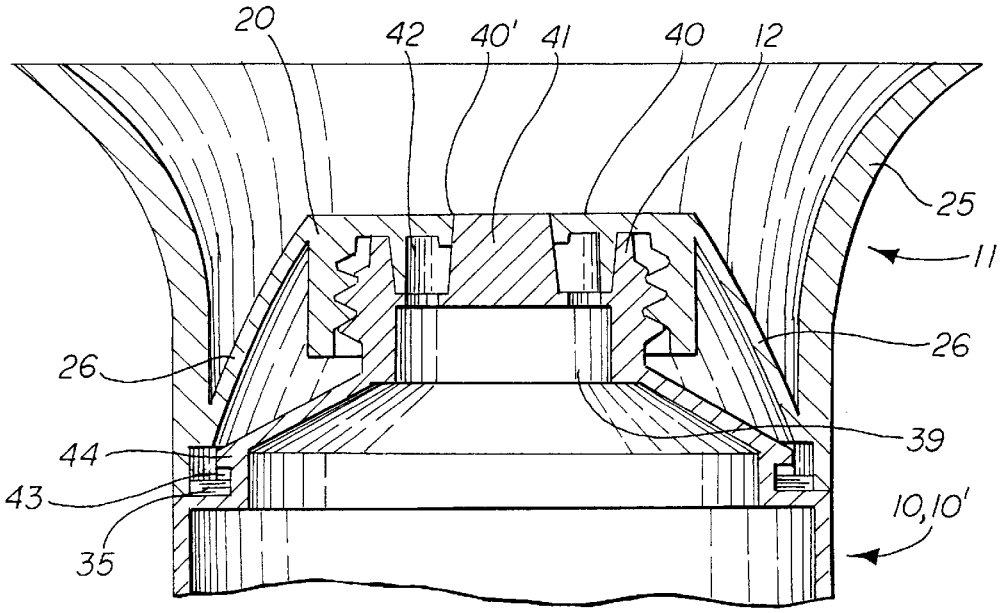
FIG. 8 is a cross-sectional side view of the container with the closure assembly in the closed position.

An alternative embodiment of the container 10, 10' and closure assembly 11 is also disclosed. This embodiment generally employs the novel inventive concepts described above. However, an important aspect of the alternate embodiment is that the closure assembly 11 is permitted to partially rotate to open the top surface 40 to allow access to the material inside the container 10, 10'. More specifically, as illustrated in FIGS. 7 and 8, the closure assembly 11 is provided with a flow-through aperture 40' through top surface 40. In the closed position, the aperture 40' is seated on a cooperating plug 41 that is intermittently supported by extensions 39 from the walls of the dispensing orifice 13. Extending about the aperture 40' on the inside of the cap assembly 11 is a concentric skirt portion 42 that mates with the space formed between the plug 41 and the inner wall of the dispensing orifice 13. Of course, the combination of the plug 41 and the skirt portion 42 stops material held in the container 10, 10' from escaping when the closure assembly 11 is in the closed position.

As with the preferred embodiment, the closure assembly 11 of the alternate embodiment is provided with a tab 35 (second lock element) that is designed to fit into a locking recess 30 (first lock element) (see FIG. 7). However, the locking recess 30 is indented further into the undercut 18 (see FIG. 7). Adjacent to this recess 30, a slightly raised guide track 43 is formed from an annular indentation in the undercut 18. The track 43 is oversized vertically to receive the tab 35 and to permit it to slide freely therein. An overhang 44 is formed in shoulder 15 with which the lower portion of annular web 26 mates in the closed position (see FIGS. 7*a* and 8). As shown in FIG. 7, the recess 30/locking tab 35/guide track 43 arrangement may be provided on both sides of the container 10, 10', if desired.

Figure 8A:
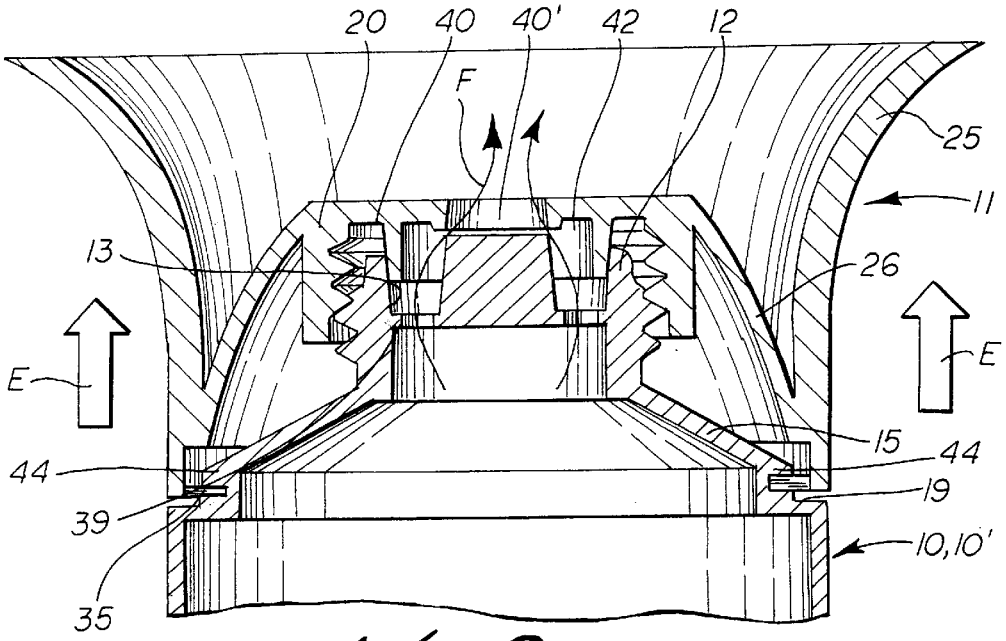
FIG. 8*a* is a cross-sectional side view of the closure assembly partially rotated, thereby permitting flow-through of the material held within the container.

In operation, the cap 25 is grasped by an adult hand H as illustrated in FIG. 3*a* and the differential manual pressure U, D is applied. As described in detail above, annular web 26 flexes under this pressure and causes the tab 35 to snap out of the recess 30. As rotational motion is imparted to the cap 11, the front surface of the now-unseated tab 35 is positioned against the inner wall 45 of guide track 43 (see FIG. 7*a*). The cap assembly 11 may then be partially rotated, which raises (note action arrows E in FIG. 8*a*) it along the cooperating threads in the neck 12 and the cap portion 20. This permits the material held in the container 10, 10' to flow past the plug 41 and through aperture 40' in the closure assembly 11 for use (see curved action arrows F in FIG. 8*a*). However, because the tab 35 is trapped by the overhang 44 within the guide track 43, and the cap portion 20 is threaded to the neck 12, the closure assembly 25 cannot be removed from the container 10, 10'.

To close the container 10, 10', the rotation is simply reversed with minimal or without the application of any differential pressure U, D. After sufficient rotation, the tab 35 will again be seated in the deep recess 30 and substantially locked into position. Thus, the alternate embodiment retains the child resistant characteristics, but permits ready access to the material held within the container without necessitating complete removal of the closure assembly 11. Of course, the trapped tab 35 also provides the advantageous feature of guarding against loss of the closure assembly 11.

In view of the foregoing description of the present invention, it can be understood that several benefits and advantages over the prior art are obtained. The locking relationship between the container 10, 10' and the closure assembly 11 allows for ease of use by an adult and at the same time provides the desired increased child resistance. The differential manual pressure, represented by the additive downward manual pressure D and the upward manual pressure U, allows an adult to easily open the container, whereas a child cannot do so.

The closure assembly 11 is easy to manufacture as an integral molded plastic part so that an additional advantage is gained over the prior art, especially with regard to two piece closures. The resilient web 26 can be easily flexed during disengagement of the locking elements 35, with the built-in memory assuring a return to the secure and locked closed relationship.

As the closure assembly 11 is turned in the closing direction C, the cam edge 50 provides for the tabs 35 to snap past the recesses 30 allowing substantially easier operation. In addition, the curved and tapered frusto-conical shape of the cup 25 of the closure assembly 11 provides for easier gripping during release of the locking relationship. When the tube 10/bottle 10' is inverted, the cup 25 forms a base that has enhanced stability.

In an alternate embodiment, a guide track 43 is provided along the undercut 18 of the container 10, 10' that serves to trap the locking tab 35. Thus, the closure assembly 11 may be partially rotated about the threaded neck 12 of container 10, 10'. However, because the tab 35 is trapped, full removal of the closure assembly is not permitted. An aperture formed in the top surface 40 of the cap portion 20 is seated on a plug 41 in the closed position. Rotation of the closure permits the material held in the container 10, 10' to flow through the aperture 40' for use.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A child resistant container and closure assembly, said container including a cylindrical threaded neck and a shoulder portion extending from the neck to a body and a first lock element adjacent said shoulder portion, said closure assembly including a mating cap portion having a top surface opposite a threaded opening for receiving said threaded neck, the improvement comprising:

a cup extending around said cap portion;

a second disengageable lock element adjacent the bottom edge of said cup to mate with said first lock element; and a resilient member attached to said cap portion supporting said cup to permit upward flexing movement of said second lock element to disengage from said first lock element, said resilient member including a flexible web extending from adjacent said top surface of said cap portion downwardly to adjacent said bottom edge of said cup;

whereby upon applying differential manual pressure between said cap portion and said cup said web flexes to allow said cup to lift sufficiently to disengage said second lock element such that said cap portion can be rotated by simultaneously manually turning said cup.

2. The container and closure assembly of claim 1, wherein said cap portion includes a top surface opposite said threaded opening to receive said manual pressure for opening, said top surface having an aperture formed therein;

said threaded opening having a plug formed therein for mating with said aperture;

said shoulder further including an annular guide track formed adjacent said first lock element for receiving and trapping said second lock element;

whereby upon applying differential manual pressure between said cap portion and said cup tending to lift said cup sufficiently to disengage said second lock element, said cap portion may be partially rotated by simultaneously manually turning said cup such that material in said container can flow past said plug and through said aperture.

3. The container and closure assembly of claim 1, wherein said web is annular and extends substantially around the inside of said cup and the outside of said cap portion.

4. The container and closure assembly of claim 3, wherein said closure assembly is formed of plastic, said cap portion, annular web and cup being unitary.

5. The container and closure assembly of claim 4, wherein said annular web is bowed slightly upwardly in the locked mode of said closure assembly to insure upward flexing upon application of the differential manual pressure for removal of said closure assembly.

6. A child-resistant container assembly including a container having a cylindrical threaded neck and a shoulder portion extending from the neck to a body and a first lock element formed in said shoulder portion, comprising:

a closure assembly for said container including a cap portion with a threaded opening for receiving said threaded neck, said cap portion including a top surface opposite said threaded opening, said top surface having an aperture formed therein;

a cup extending around said cap portion;

said closure assembly having a second disengageable lock element adjacent the bottom edge of said cup to mate with said first lock element;

a resilient member attached to said cap portion supporting said cup to permit upward flexing movement of said second lock element to disengage from said first element, said threaded opening having a plug formed therein for mating with the aperture in said top surface;

said cap portion further including a concentric skirt portion for sealingly engaging said plug;

said shoulder further including an annular guide track formed adjacent said first lock element for receiving and trapping said second lock element;

whereby upon applying differential manual pressure between said cap portion and said cup tending to lift said cup sufficiently to disengage said second lock element, said closure assembly may be partially rotated such that material in said container can flow past said plug and through said aperture.

7. A child-resistant assembly for holding a viscous material therein, comprising:

a container having a cylindrical threaded neck and a shoulder portion extending from the neck to a body and a first lock element formed in said shoulder portion;

a closure assembly having a cap portion with a threaded opening for receiving said threaded neck, said cap portion including a top surface opposite said threaded opening having an aperture formed therein;

a cup extending around said cap portion;

said closure assembly having a second disengageable lock element adjacent the bottom edge of said cup to mate with said first lock element;

a resilient member attached to said cap portion supporting said cup to permit upward flexing movement of said second lock element to disengage from said first lock element;

said threaded opening having a plug formed therein for mating with the aperture in said top surface;

said shoulder further including an annular guide track formed adjacent said first lock element for receiving and trapping said second lock element;

whereby upon applying differential manual pressure between said cap portion and said cup tending to lift said cup sufficiently to disengage said second lock element, said closure assembly may be partially rotated such that material in said container can flow past said plug and through said aperture.

8. A child resistant container and closure assembly, said container including a cylindrical threaded neck and a shoulder portion extending from the neck to a body and a first lock element adjacent said shoulder portion, said closure assembly including a mating cap portion with a threaded opening for receiving said threaded neck, the improvement comprising:

a cup extending around said cap portion;

a second disengageable lock element adjacent the bottom edge of said cup to mate with said first lock element;

a resilient member attached to said cap portion supporting said cup to permit upward flexing movement of said second lock element to disengage from said first element, said cup being flared upwardly and outwardly from said bottom edge to form a curved frusto-conical outer surface, whereby said differential manual pressure may be applied by a thumb engaging said top surface of said cap portion, and a forefinger/middle finger engaging opposite sides of said outer surface of said cup.

9. The container and closure assembly of claim 8, wherein said closure assembly forms a base for said container when inverted;

said cup of the closure assembly extending sufficiently outwardly from the radial extent of said container to provide enhanced stability.

10. A child resistant container and closure assembly, said container including a cylindrical threaded neck and a shoulder portion extending from the neck to a body, said closure assembly including a mating cap portion with a threaded opening for receiving said threaded neck, the improvement comprising:

a cup extending around said cap portion;

said shoulder portion of said container including at least one inwardly directed recess;

at least one inwardly directed tab adjacent the bottom edge of said cup to fit in said recess in said container in a locked mode; and a resilient member attached to said cap portion supporting said cup to permit upward movement of said tab to disengage from said recess, whereby upon applying differential manual pressure between said cap portion and said cup tending to lift said cup sufficiently to disengage said tab, said cap portion can be rotated by simultaneously manually turning said cup.

11. The container and closure assembly of claim 10, wherein said tab has a chamfered edge forming a cam in the closing direction of rotation to assist in turning said closure assembly to the locked mode, and a substantially radially extending edge to match a corresponding radial edge of said recess in the opening direction, whereby said tab can at least partially snap past said recess during rotation in the closing direction and is prevented from rotation in the opening direction except upon application of the differential manual pressure.

12. The container and closure assembly of claim 10, wherein is provided an annular rim on said container extending outwardly from said shoulder, said recess opening outwardly to said rim, and said bottom edge of said cup being undercut around a substantial portion of said edge to form said tab and allow ease of turning in the closing direction, said bottom edge of said cup engaging said rim to form a smooth transition between said container and said closure assembly.

13. The container and closure assembly of claim 12, wherein approximately one-half of said tab extends into said recess to allow inward flexing of said bottom edge of said closure assembly spaced substantially 90° from said tab to allow the caming action of said tab upon turning in the closing direction.

* * * * *